US007832033B1

(12) United States Patent
Berkshire

(10) Patent No.: US 7,832,033 B1
(45) Date of Patent: Nov. 16, 2010

(54) COVER FOR PREVENTING A PERSON LYING ON A BED FROM FALLING OFF THE BED

(76) Inventor: Glen Berkshire, 557 Lee Ave., Harrisonburg, VA (US) 22802

( * ) Notice: Subject to any disclaimer, the term of this patent is extended or adjusted under 35 U.S.C. 154(b) by 0 days.

(21) Appl. No.: 12/660,041

(22) Filed: Feb. 20, 2010

Related U.S. Application Data

(60) Provisional application No. 61/208,283, filed on Feb. 24, 2009.

(51) Int. Cl.
*A47C 21/02* (2006.01)

(52) U.S. Cl. ..... 5/424; 5/494; 5/498; 5/659; 5/505.1; 128/869

(58) Field of Classification Search ..... 5/424, 5/494, 496, 498, 504.1, 505.1, 659; 128/869, 128/872
See application file for complete search history.

*Primary Examiner*—Michael Trettel

(57) ABSTRACT

A device to prevent a person lying on a bed from falling off the bed, while allowing the person freedom to change sleeping positions and to enter and exit a bed without assistance. This device consists of a washable fabric cover with four cylinder sleeves on each longitudinal side of cover. An elongated support member is inserted into one of the cylinder sleeves on each side of cover. The elongated support member and cover are removably held in place along each longitudinal side of a mattress by brackets. The brackets are anchored between a box springs and a frame of a bed.

1 Claim, 4 Drawing Sheets

COVER FOR PREVENTING A PERSON LYING ON A BED FROM FALLING OFF THE BED

CROSS-REFERENCE TO RELATED APPLICATIONS

This application claims the benefit of PPA Ser. No. 61/208,283, filed 2009 Feb. 24 by the present inventor.

FEDERALLY SPONSORED RESEARCH

Not Applicable

SEQUENCE LISTING OR PROGRAM

Not Applicable

BACKGROUND

1. Field of Invention

The present invention relates to an apparatus for preventing a person lying on a bed from falling off the bed.

2. Prior Art

It is widely known that it may become necessary, for various reasons, to use an apparatus for preventing a person lying on a bed from falling off the bed during periods of sleep or when a person is unsupervised. For example, if a person is agitated in his sleep, due to dreams or physical conditions such as Periodic Limb Movement Disorder (PLMD) or insomnia, he may fall off the bed, perhaps inflicting serious injuries upon himself. Also, with certain types of physical limitations or injuries, changing positions in bed may be difficult, and it may be desirable to limit the possibility of falling off the bed.

In many cases, people have resorted to using bed rails, which have several disadvantages. Firstly, bed rails are not visually pleasing, especially in a home setting. Secondly, bed rails make entering and exiting a bed very difficult, and installing and removing rails could be difficult for an elderly or injured person. Thirdly, it is possible for a person to seriously injure himself if he tries to climb over or around bed rails.

U.S. Pat. No. 4,653,131 to Diehl (1987), titled Bed Sheet Restraint, does not meet the requirements for in home use by a self-functioning individual. This restraint needs to be attached to the bed by a second individual after a person is lying in bed, and it renders the reclining individual helpless to exit the bed when necessary.

Likewise, U.S. Pat. No. 5,623,950 to Bergeron (1997), titled Security Cover, is also an inferior product. This restraint is "made of a flexible and sturdy material such as canvas, tarpaulin, or the like". This material is heavy, hot, hard to manipulate, hard to wash, and would not be conducive to providing a clean, cool, and comfortable sleeping environment.

Additionally, this cover has attached snap hooks that attach to a "flexible line" so that the cover can be slid up and down. Since material used for this flexible line is not specified, one may conclude that after much use, this flexible line may become frayed, brittle, or sharp, thus causing the line to break, snap, or cause injury, such as cutting the skin. Also, there is a risk of injury if an individual's arms or legs get caught in the openings that exist between the cover and the wire. According to this patent, a second person is needed to finally secure the security cover in place.

There is therefore clearly a need for an improved apparatus for preventing a person lying on a bed from falling off the bed.

SUMMARY

In accordance with one embodiment, an apparatus for preventing a person lying on a bed from falling off the bed comprises a cover with cylinder sleeves, elongated support members, brackets, and pins.

DRAWINGS

Figures

DRAWINGS

Reference Numerals

| | | | |
|---|---|---|---|
| 20 | cover | 28 | pin |
| 22 | cylinder sleeve | 32 | longitudinal side of mattress |
| 24 | elongated support member | 34 | mattress |
| 26 | bracket | 36 | box springs |

DETAILED DESCRIPTION

Figure 1:
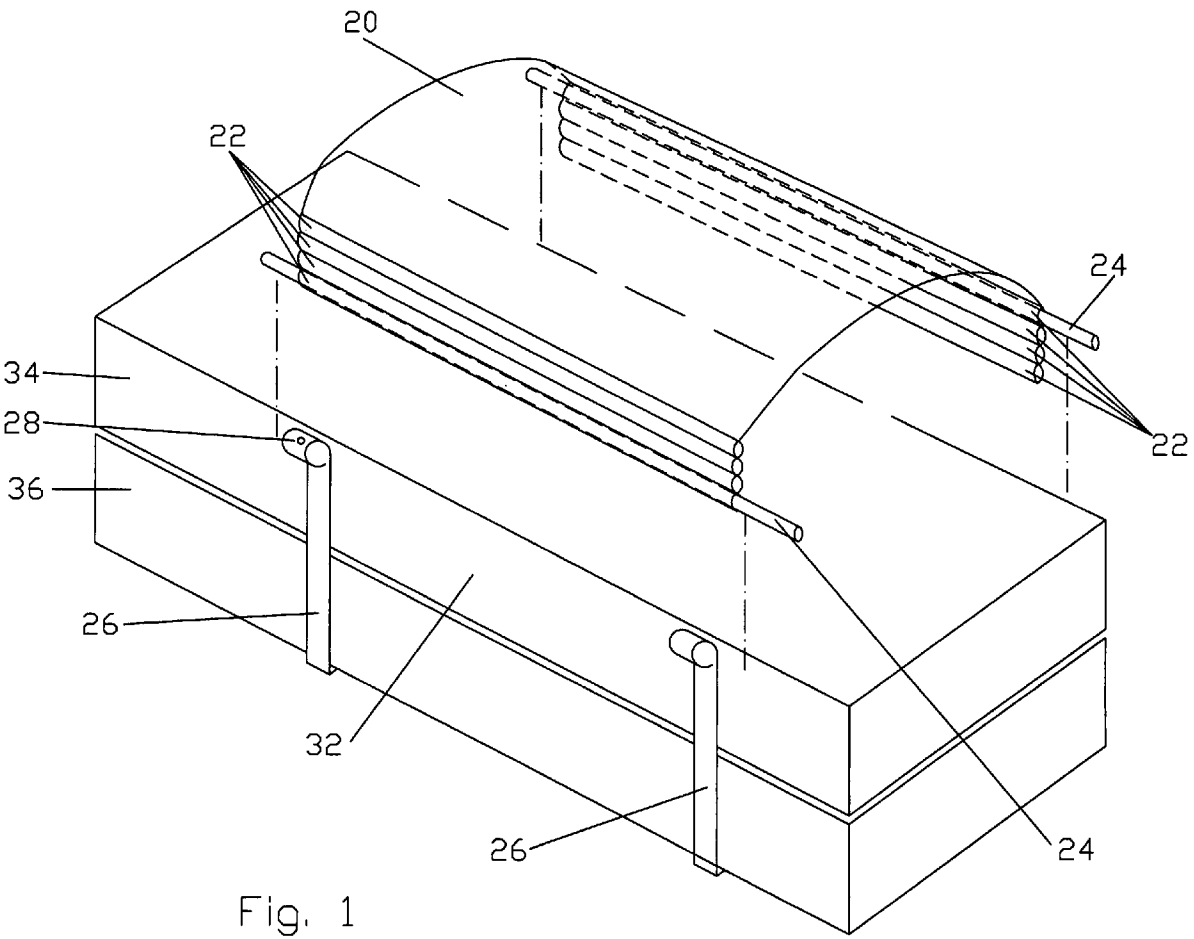
FIG. 1 shows a perspective view of one embodiment of the apparatus for preventing a person from falling off a bed.
Figure 2:
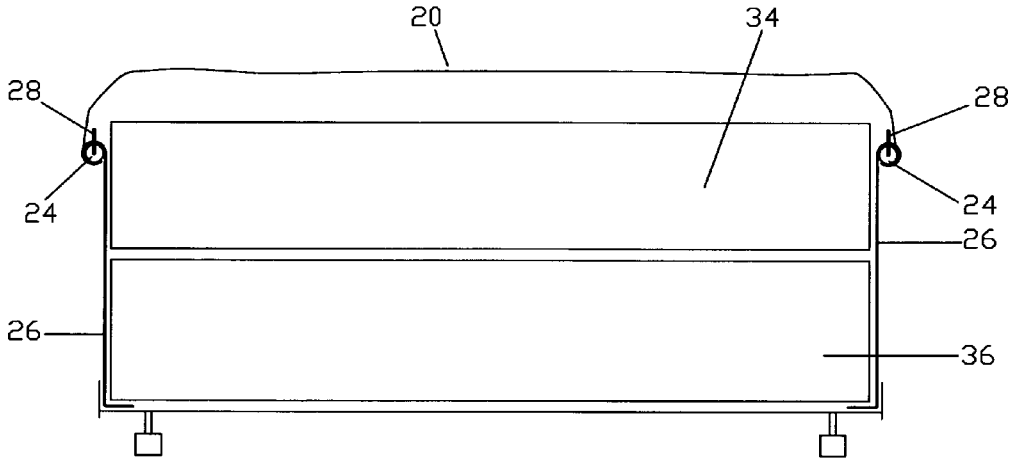
FIG. 2 shows end view of one embodiment of the apparatus for preventing a person from falling off a bed.
Figure 3A:
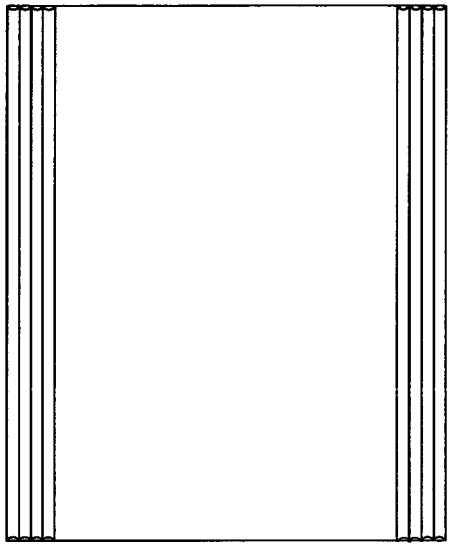
FIG. 3A shows top view of cover.
Figure 3B:
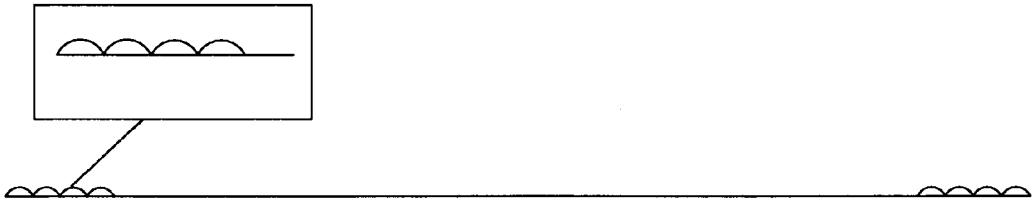
FIG. 3B shows end view of cover.
Figure 4A:
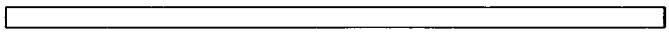
FIG. 4A shows side view of elongated support member.
Figure 4B:
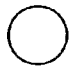
FIG. 4B shows end view of elongated support member.
Figure 5A:
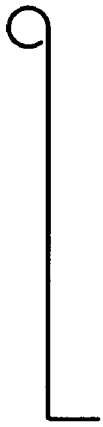
FIG. 5A shows side view of bracket.
Figure 5B:
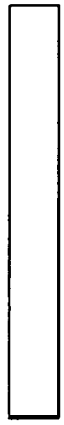
FIG. 5B shows back view of bracket.
Figure 5C:
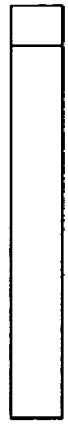
FIG. 5C shows front view of bracket.
Figure 6:
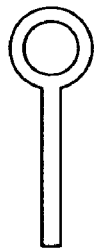
FIG. 6 shows side view of pin.

FIGS. 1 and 2—Preferred Embodiment

One embodiment of the apparatus is illustrated in FIG. 1 (perspective view) and FIG. 2 (end view). The apparatus has a fabric cover 20 that can be repeatedly washed. The approximate length of cover 20 is 1.7 m. The width of cover 20 is determined by the size of bed, such as twin, full, queen, or king. In the preferred embodiment, cover 20 is made of cotton. However, cover 20 can consist of any other fabric that can be repeatedly washed, such as a cotton blend, flannel, or microfiber, etc.

Cover 20 has a plurality of cylinder sleeves 22 on each longitudinal side. The plurality of cylinder sleeves is provided to accommodate various sizes of individuals, both large and small. In the preferred embodiment, cover 20 has four cylinder sleeves 22 on each longitudinal side. Cylinder sleeves 22 are made by folding each longitudinal edge of fabric inward on top of fabric. Longitudinal lines are sewn with thread and sewing machine to create four cylinder sleeves 22. However, cylinder sleeves can be made by an alternative method.

The apparatus has two elongated support members 24 approximately 1.22 m in length. The diameter is approximately 2.54 cm. In the preferred embodiment, elongated support member 24 is a rod made of wood. However, the elongated support members can be of any material that is sturdy and rigid, such as metal or plastic, etc.

The apparatus consists of four brackets 26. The length of bracket 26 is determined by the height of mattress 34 and box springs 36. Bracket 26 has a circular opening at one end and an L-shape at the second end. In the preferred embodiment, bracket 26 is made of metal. However, bracket 26 can be made of any material that is sturdy and rigid.

The apparatus has two pins 28. In the preferred embodiment, pin 28 is substantially a cotter pin and is made of metal. However, pin 28 can be made of any material that is sturdy and rigid and can have a similar shape.

OPERATION

FIGS. 1 AND 2—Preferred Embodiment

Cover 20 is placed across a bed between a fitted mattress sheet and a top flat sheet or blanket. The length of cover 20 fits over an adult's torso, thus allowing free movement of arms and legs. Each of two elongated support members 24 is inserted into one of the four cylinder sleeves 22 on each longitudinal side of cover 20. Brackets 26 are placed at the longitudinal sides of a mattress 32. The L-shape end of bracket 26 fits between box springs 36 and the frame of a bed. Each end of elongated support member 24 is inserted through the circular opening end of each of two brackets 26. Brackets 26 hold the elongated support members 24 and cover 20 in place along each longitudinal side of mattress 32. Bracket 26 is held in place by the weight of box springs 36. Removable pin 28 is inserted through one bracket 26 on each longitudinal side of mattress 32 and one end of each elongated support member 24 to keep elongated support member 24 from moving while in use.

This apparatus can be operated from either side of a bed. The apparatus can be operated from only one side of a bed if desired, since it will not bind. When entering a bed, the individual pulls cover 20 down, which glides along elongated support member 24. After positioning herself, she then pulls cover 20 up over her torso. Since the plurality of cylinder sleeves 22 allows for various sizes of individuals, she will have a comfortable fit. And, since there are no openings between elongated support members 24 and cover 20, she will have a safe sleeping environment.

To wash cover 20, an individual simply removes pin 28 from bracket 26 and elongated support member 24. Each end of elongated support member 24 is removed from the circular opening end of bracket 26. Elongated support member 24 is then removed from cylinder sleeve 22 on cover 20.

CONCLUSION, RAMIFICATIONS, AND SCOPE

Accordingly, the reader will see that the apparatus can prevent a person lying on a bed from falling off the bed. The apparatus can be easily operated by one person from either side of a bed and can be easily removed for washing. The apparatus can provide a safe, clean, cool, and comfortable sleeping environment that allows a person to change sleeping positions and allows a person to enter and exit a bed without assistance.

Although the description above contains many specificities, these should not be construed as limiting the scope of the embodiment, but as merely providing an illustration of one of the presently preferred embodiments. For example, the cover can be made of other fabrics, such as a cotton blend, flannel, or microfiber, etc; the elongated support members, brackets, and pins can be different sizes and can be made of other materials, etc.

Thus the scope of the embodiment should be determined by the appended claims and their legal equivalents, rather than by the examples given.

I claim:

1. An apparatus for use in preventing a person lying on a bed from falling off of bed, the bed being of the type having a mattress mounted on a mattress support or box springs including two opposite longitudinal sides, the apparatus comprising:

(a) a cover having opposite longitudinal sides, said cover having a predetermined size, said cover having a plurality of cylinder sleeves on each longitudinal side, (b) two elongated support members of equal length, said support members being slidably inserted into one of said cylinder sleeves on each longitudinal side of said cover, (c) four brackets, said brackets having an L-shape at one end and a circular opening at a second end, two of said brackets being placed on each longitudinal side of said bed, said L-shape end of said bracket being inserted between said mattress support or box springs and a frame of a bed, ends of each elongated support member being inserted in said circular openings of said brackets on each longitudinal side of said mattress, and (d) two pins, said pins securing said elongated support members to said brackets, whereby an individual can have a safe sleeping environment, while being able to change positions and enter and exit a bed without assistance.

* * * * *